US007523620B2

(12) United States Patent
Umemura et al.

(10) Patent No.: US 7,523,620 B2
(45) Date of Patent: Apr. 28, 2009

(54) DISPLACEMENT CONTROL MECHANISM FOR VARIABLE DISPLACEMENT COMPRESSOR

(75) Inventors: Satoshi Umemura, Kariya (JP); Masahiro Kawaguchi, Kariya (JP); Masaki Ota, Kariya (JP); Tatsuya Hirose, Kariya (JP); Yuji Hashimoto, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 453 days.

(21) Appl. No.: 11/313,542

(22) Filed: Dec. 20, 2005

(65) Prior Publication Data

US 2007/0012057 A1 Jan. 18, 2007

(30) Foreign Application Priority Data

Dec. 24, 2004 (JP) ..... 2004-373425

(51) Int. Cl.
*F25B 1/00* (2006.01)
*F25B 49/00* (2006.01)
*F04B 1/26* (2006.01)

(52) U.S. Cl. ..... 62/228.3; 417/222.2

(58) Field of Classification Search ..... 62/228.3, 62/228.5; 417/213, 222.2, 279
See application file for complete search history.

(56) References Cited

U.S. PATENT DOCUMENTS 5,588,807 A 12/1996 Kimura et al. ..... 417/222.2
5,603,610 A 2/1997 Kawaguchi et al.
5,988,988 A * 11/1999 Tokumasu ..... 417/222.2
6,015,269 A * 1/2000 Ota et al. ..... 417/222.2
6,371,734 B1 4/2002 Ota et al. ..... 417/222.2
2001/0007194 A1* 7/2001 Kimura et al. ..... 62/228.3
2001/0052236 A1* 12/2001 Ota et al. ..... 62/228.3
2002/0069657 A1* 6/2002 Fujii et al. ..... 62/228.3
2002/0069658 A1* 6/2002 Ota et al. ..... 62/228.5
2002/0112493 A1* 8/2002 Umemura et al. ..... 62/228.3
2002/0144512 A1* 10/2002 Fukanuma et al. ..... 62/228.3
2003/0014990 A1* 1/2003 Fukasaku et al. ..... 62/228.3
2003/0024257 A1* 2/2003 Hirota et al. ..... 62/228.3

(Continued)

FOREIGN PATENT DOCUMENTS

DE 44 39 512 A1 5/1995

(Continued)

OTHER PUBLICATIONS

German Office Action dated Apr. 10, 2008, received in corresponding German Patent Application No. 10 2005 061 817.0-15 without English translation.

*Primary Examiner*—Marc E Norman
(74) *Attorney, Agent, or Firm*—Locke Lord Bissell & Liddell, LLP

(57) ABSTRACT

A displacing device is incorporated in a displacement control valve. The displacing device includes a first pressure chamber, a second pressure chamber, a second bellows, a transmission rod, and an urging spring. The second pressure chamber communicates with a suction chamber. The interior of the second pressure chamber is a suction pressure zone. When the pressure in the suction pressure zone is less than or equal to a predetermined reference pressure, the transmission rod moves an actuation rod (valve body) to open a valve hole. Therefore, a variable displacement compressor is prevented from operating with a large displacement when there is insufficient amount of refrigerant or when the speed of the compressor is high.

9 Claims, 5 Drawing Sheets

U.S. PATENT DOCUMENTS

| | | | | |
|---|---|---|---|---|
| 2003/0145615 | A1* | 8/2003 | Sasaki et al. | 62/228.3 |
| 2003/0154731 | A1* | 8/2003 | Imai et al. | 62/228.3 |
| 2003/0202885 | A1* | 10/2003 | Taguchi | 417/213 |
| 2005/0053475 | A1* | 3/2005 | Urbank et al. | 417/222.2 |
| 2005/0163624 | A1* | 7/2005 | Taguchi | 417/222.2 |
| 2005/0287014 | A1 | 12/2005 | Umemura et al. | 417/222.1 |
| 2006/0165534 | A1* | 7/2006 | Umemura et al. | 417/222.2 |

FOREIGN PATENT DOCUMENTS

| | | |
|---|---|---|
| JP | 05-306679 | 11/1993 |
| JP | 06-147115 | 5/1994 |
| JP | 2001-065455 | 3/2001 |
| JP | 2001-153044 | 6/2001 |
| JP | 2004-108245 | 4/2004 |

* cited by examiner

DISPLACEMENT CONTROL MECHANISM FOR VARIABLE DISPLACEMENT COMPRESSOR

BACKGROUND OF THE INVENTION

The present invention relates to a displacement control mechanism for a variable displacement compressor. The displacement control mechanism supplies refrigerant from a discharge pressure zone to a control pressure chamber and delivers refrigerant from the control pressure chamber to a suction pressure zone, thereby controlling the pressure in the control pressure chamber, and changing the displacement of the compressor, accordingly.

In a variable displacement compressor having a control pressure chamber for accommodating a tiltable swash plate, the inclination angle of the swash plate is reduced as the pressure in the control pressure chamber is increased, and increased as the control chamber pressure is reduced. When the inclination angle of the swash plate is reduced, the stroke of the pistons is reduced, which decreases the displacement of the compressor. When the inclination angle of the swash plate is increased, the piston stroke is increased, which increases the displacement.

Japanese Laid-Open Patent Publication No. 2001-153044 discloses a displacement control valve that opens and closes a supply passage for supplying refrigerant from a discharge pressure zone to a crank chamber serving as a control pressure chamber. The displacement control valve includes a solenoid and a pressure sensing device that senses a pressure difference between two positions in the discharge pressure zone to actuate a valve body. When the refrigerant flow rate increases, the pressure difference between the two positions increases, accordingly. The pressure sensing device uses the increase in the pressure difference to displace the valve body in a direction opening a valve hole. This increases the pressure in the crank chamber, and thus reduces the displacement. In contrast, when the refrigerant flow rate decreases, the pressure difference between the two positions decreases, accordingly. The pressure sensing device uses the decrease in the pressure difference to displace the valve body in a direction closing the valve hole. This decreases the pressure in the crank chamber, and thus increases the displacement.

The displacement control valve includes a solenoid that applies electromagnetic force to the valve body against the pressure difference. The opening degree of the displacement control valve is varied by changing the value of a current supplied to the solenoid (duty ratio). The supplied current value (duty ratio) to the solenoid is determined by a controller. The controller determines the supplied current value (duty ratio) to the solenoid, for example, according to the difference between a set target compartment temperature and a detected compartment temperature.

If the variable displacement compressor operates with a shortage of refrigerant gas, the compartment temperature will never be lowered to the target temperature. To deal with the situation, the controller executes control for maximizing the supplied current value (duty ratio) to the solenoid (control for maximizing the inclination angle of the swash plate). That is, the variable displacement compressor operates with the maximum displacement even if the speed of the rotary shaft is high and the refrigerant flow rate is increased. Such high speed and large displacement operation applies a great load on the compressor, particularly on the swash plate, and is therefore unfavorable in terms of the reliability. Also, due to the shortage of the refrigerant gas, the discharge pressure cannot be increased. Therefore, high speed and large displacement operation with an insufficient amount of refrigerant gas causes the following disadvantages, for example, to a compressor having a hinge mechanism disclosed in Japanese Laid-Open Patent Publication No. 2004-108245. The hinge mechanism has a configuration in which a projection formed on the swash plate is simply held between a pair of projections formed on a rotary support to allow the swash plate to move freely along the axial direction of the rotary shaft. In the case of a compressor equipped with such a hinge mechanism, high speed and large displacement operation may cause inertial force of pistons to surpass the compression reaction force. As a result, the inclination angle of the swash plate in the maximum displacement operation can surpass a predetermined maximum inclination. If the inclination angle surpasses the predetermined maximum inclination angle, the pistons can collide with the plate in which suction valve flaps are formed.

Also, even if there is a sufficient amount of refrigerant gas, high speed and large displacement operation of a variable displacement compressor is not favorable in terms of the reliability. Further, even if there is a sufficient amount of refrigerant gas, a great inertial force of the pistons can cause the inclination angle of the swash plate to surpass the predetermined maximum inclination angle in the case of the hinge mechanism disclosed in Japanese Laid-Open Patent Publication No. 2004-108245.

SUMMARY OF THE INVENTION

Accordingly, it is an objective of the present invention to prevent a variable displacement compressor from operating with a large displacement when there is insufficient amount of refrigerant or when the speed of the compressor is high.

To achieve the foregoing objectives, the present invention provides a displacement control mechanism for a variable displacement compressor that compresses refrigerant in a suction pressure zone and delivers the compressed refrigerant to a discharge pressure zone. The compressor includes a control pressure chamber, a supply passage that connects the discharge pressure zone to the control pressure chamber, and a delivery passage that connects the suction pressure zone to the control pressure chamber. The displacement control mechanism permits refrigerant in the discharge pressure zone to be supplied to the control pressure chamber through the supply passage and permits refrigerant in the control pressure chamber to be delivered to the suction pressure zone through the delivery passage, thereby adjusting the pressure in the control pressure chamber to control the displacement of the compressor. The displacement control mechanism includes a valve hole forming a part of the supply passage or the delivery passage, and a valve body for opening and closing the valve hole. A pressure sensing device urges the valve body with a force that corresponds to a pressure difference between a first position and a second position, which are located in the discharge pressure zone. When the pressure in the suction pressure zone falls below a predetermined reference pressure, a displacing device produces a driving force for displacing the valve body. When the valve hole forms a part of the supply passage, the displacing device displaces the valve body in a direction increasing the opening degree of the valve hole with the driving force. When the valve hole forms a part of the delivery passage, the displacing device displaces the valve body in a direction reducing the opening degree of the valve hole with the driving force.

BRIEF DESCRIPTION OF THE DRAWINGS

The features of the present invention that are believed to be novel are set forth with particularity in the appended claims.

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1A to 2B.

Figures 1A, 1B:
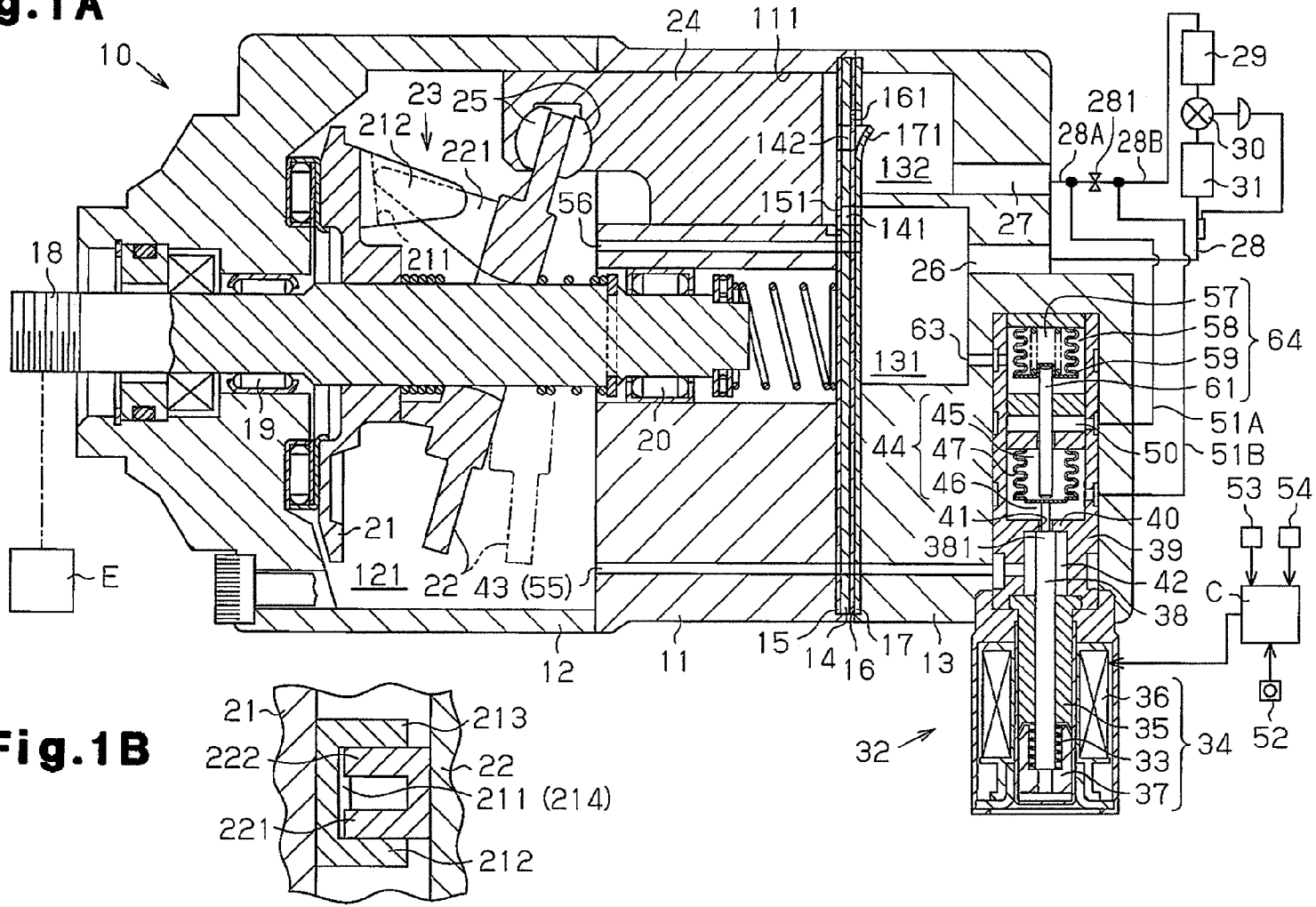
FIG. 1A is a side cross-sectional view illustrating an entire compressor according a first embodiment of the present invention.
FIG. 1B is a cross-sectional view illustrating the hinge mechanism shown in FIG. 1A.

As shown in FIG. 1A, a front housing member 12 is secured to the front end of a cylinder block 11. A rear housing member 13 is secured to the rear end of the cylinder block 11 with a valve plate 14, valve flap plates 15, 16, and a retainer plate 17 arranged in between. The cylinder block 11, the front housing member 12, and the rear housing member 13 form a housing of a compressor 10.

The front housing member 12 and the cylinder block 11 define a control pressure chamber 121. The front housing member 12 and the cylinder block 11 rotatably support a rotary shaft 18 with radial bearings 19, 20. The rotary shaft 18 projects from the control pressure chamber 121 to the outside, and receives power from a vehicle engine E, which is an external power source, through an electromagnetic clutch (not shown).

A rotary support 21 is fixed to the rotary shaft 18, and a swash plate 22 is supported on the rotary shaft 18. The swash plate 22 is permitted to incline with respect to and slide along the rotary shaft 18.

As shown in FIG. 1B, the rotary support 21 has a pair of arms 212, 213 projecting toward the swash plate 22, and the swash plate 22 has a pair of projections 221, 222 projecting toward the rotary support 21. The projections 221, 222 are located in a recess 214 defined by the pair of the arms 212, 213. The projections 221, 222 are held between the pair of the arms 212, 213 to be movable in the recess 214. The bottom of the recess 214 is formed to be a cam surface 211, along which distal ends of the projections 221, 222 slide. The engagement of the projections 221, 222 held between the arms 212, 213 and the cam surface 211 allows the swash plate 22 to be tiltable with respect to the rotary shaft 18 and rotatable together with the rotary shaft 18. The cam surface 211 slidably guides the projections 221, 222, and the rotary shaft 18 slidably supports the swash plate 22. These actions permit the swash plate 22 to be inclined. The pair of the arms 212, 213 and the projections 221, 222 form a hinge mechanism 23 between the swash plate 22 and the rotary support 21. The hinge mechanism 23 couples the swash plate 22 to the rotary support 21 such that the swash plate 22 can be inclined, and that torque can be transmitted from the rotary shaft 18 to the swash plate 22.

When the center of the swash plate 22 moves toward the rotary support 21, the inclination angle of the swash plate 22 increases. When contacting the swash plate 22, the rotary support 21 determines the maximum inclination of the swash plate 22. When in a position indicated by solid lines in FIG. 1A, the swash plate 22 is at the maximum inclination position. When in a position indicated by chain lines, the swash plate 22 is at the minimum inclination position.

Cylinder bores 111 extend through the cylinder block 11. Each cylinder bore 111 accommodates a piston 24. The rotation of the swash plate 22 is converted to reciprocation of the pistons 24 by means of shoes 25. Thus, each piston 24 reciprocates in the corresponding cylinder bore 111.

A suction chamber 131 and a discharge chamber 132 are defined in the rear housing member 13. Suction ports 141 are formed in the valve plate 14, the valve flap plate 16, and the retainer plate 17. Discharge ports 142 are formed in the valve plate 14 and the valve flap plate 15. Suction valve flaps 151 are formed on the valve flap plate 15, and discharge valve flaps 161 are formed on the valve flap plate 16. As each piston 24 moves from the top dead center to the bottom dead center (from the right side to the left side as viewed in FIG. 1A), the refrigerant in the suction chamber 131, which is a suction pressure zone, is drawn into the associated cylinder bore 111 through the corresponding suction port 141 while flexing the suction valve flap 151. When each piston 24 moves from the bottom dead center to the top dead center (from the left side to the right side as viewed in FIG. 1A), the gaseous refrigerant in the corresponding cylinder bore 111 is discharged to the discharge chamber 132, which is a discharge pressure zone, through the corresponding discharge port 142 while flexing the discharge valve flap 161. The retainer plate 17 includes retainers 171, which correspond to the discharge valves 161. Each retainer 171 restricts the opening degree of the corresponding discharge valve flap 161.

A suction passage 26 for guiding refrigerant into the suction chamber 131 and a discharge passage 27 for discharging refrigerant from the discharge chamber 132 are connected to each other by an external refrigerant circuit 28. A first heat exchanger 29 for drawing heat from refrigerant, an expansion valve 30, and a second heat exchanger 31 for transferring the ambient heat to refrigerant are located on the external refrigerant circuit 28. The expansion valve 30 controls the flow rate of refrigerant in accordance with fluctuations of the gas temperature at the outlet of the second heat exchanger 31. An orifice 281 is provided in a section of the external refrigerant circuit that is downstream of the discharge passage 27 and upstream of the first heat exchanger 29. This section of the external refrigerant includes a first external refrigerant circuit section 28A that is upstream of the orifice 281 and a second external refrigerant circuit section 28B that is downstream of the orifice 281.

An electromagnetic displacement control valve 32 is installed in the rear housing member 13.

Figure 2A:
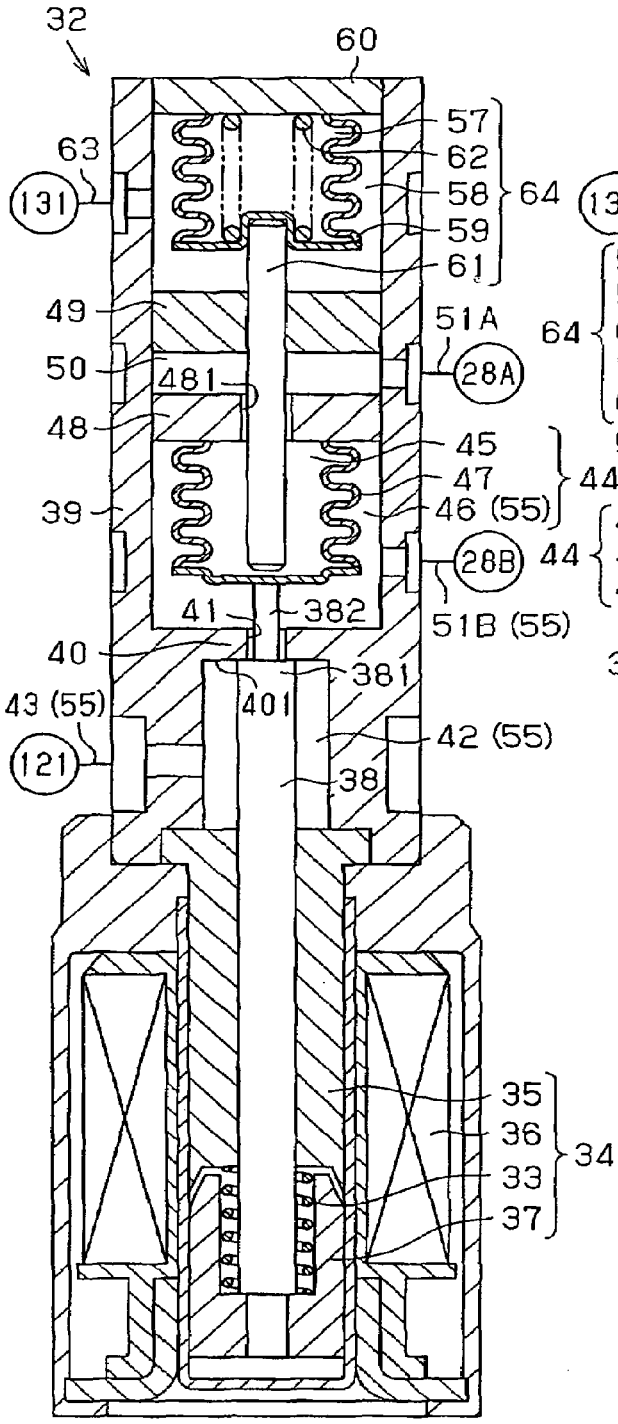
FIG. 2A is an enlarged cross-sectional view illustrating the displacement control valve shown in FIG. 1A.

As shown in FIG. 2A, the displacement control valve 32 includes a solenoid 34. A fixed iron core 35 of the solenoid 34 attracts a movable iron core 37 based on excitation by current supplied to a coil 36. An urging spring 33 is located between the fixed iron core 35 and the movable iron core 37. The urging spring 33 urges the movable iron core 37 in a direction away from the fixed iron core 35. The solenoid 34 is subjected to current supply control (duty ratio control in this embodiment) executed by a control computer C (see FIG. 1A). An actuation rod 38 is fixed to the movable iron core 37.

A housing 39 forming the displacement control valve 32 has a valve seat 40. A valve hole 41 is formed in the valve seat 40. A valve chamber 42 is defined between the valve seat 40 and the fixed iron core 35. The valve hole 41 communicates with the valve chamber 42. The valve chamber 42 is connected to the control pressure chamber 121 with a passage 43.

A valve body 381 is formed integrally with a portion of the actuation rod 38 that is located in the valve chamber 42. A small diameter portion 382 adjacent to the valve body 381 extends through the valve hole 41. A space exists between the circumferential surface of the small diameter portion 382 and the circumferential wall of the valve hole 41. The valve body 381 selectively contacts and separates from a seating surface 401 of the valve seat 40. When the valve body 381 contacts the seating surface 401, the valve hole 41 is closed. When the valve body 381 separates from the seating surface 401, the valve hole 41 is opened.

A first pressure sensing chamber 45 and a second pressure sensing chamber 46 are defined in the housing 39. A first bellows 47 functions as a defining member that defines the first pressure sensing chamber 45 and the second pressure sensing chamber 46. A fixed end of the first bellows 47 is coupled to a support 48, which is fitted in and fixed to the housing 39. A movable end of the bellows 47 contacts the small diameter portion 382 of the actuation rod 38. The actuation rod 38 moves together with the first bellows 47.

A partition 49 is fitted in and fixed to the housing 39. A refrigerant introduction chamber 50 is defined between the partition 49 and the support 48. The refrigerant introduction chamber 50 is connected to the first external refrigerant circuit section 28A through a pressure introduction passage 51A. A through hole 481 is formed in the support 48. The refrigerant introduction chamber 50 is connected to the first pressure sensing chamber 45 through the through hole 481.

The first pressure sensing chamber 45 is connected to the first external refrigerant circuit section 28A, which is upstream of the orifice 281, through the through hole 481, the refrigerant introduction chamber 50, and the pressure introduction passage 51A. The second pressure sensing chamber 46 is connected to the second external refrigerant circuit section 28B, which is downstream of the orifice 281, through a pressure introduction passage 51B. That is, the interior of the first pressure sensing chamber 45 is exposed to the pressure in the first external refrigerant circuit section 28A, which is upstream of the orifice 281, while the interior of the second pressure sensing chamber 46 is exposed to the pressure in the second external refrigerant circuit section 28B, which is downstream of the orifice 281 and upstream of the first heat exchanger 29. The pressure in the first pressure sensing chamber 45 and the pressure in the second pressure sensing chamber 46 oppose each other with the bellows 47 in between.

When refrigerant is flowing through the first and second external refrigerant circuit sections 28A, 28B, the pressure in the first external refrigerant circuit section 28A, which is upstream of the orifice 281, is higher than the pressure in the second external refrigerant circuit section 28B, which is downstream of the orifice 281 and upstream of the first heat exchanger 29. When the flow rate of refrigerant in the first and second external refrigerant circuit sections 28A, 28B (discharge pressure zone) increases, the pressure difference between the sections upstream and downstream of the orifice 281 is increased. When the flow rate of refrigerant in the first and second external refrigerant circuit sections 28A, 28B (discharge pressure zone) is decreased, the pressure difference between the sections upstream and downstream of the orifice 281 is reduced. When the pressure difference between the sections upstream and downstream of the orifice 281 is increased, the pressure difference between the first and second pressure sensing chambers 45, 46 is increased. When the pressure difference between the sections upstream and downstream of the orifice 281 is reduced, the pressure difference between the first and second pressure sensing chambers 45, 46 is reduced. The pressure difference between the first and second pressure sensing chambers 45, 46 acts as force that urges the actuation rod 38 in a direction away from the valve hole 41.

The first and second pressure sensing chambers 45, 46 and the first bellows 47 form a pressure sensing device 44 that senses the pressure difference between the pressure in the first external refrigerant circuit section 28A, which is upstream of the orifice 281, and the pressure in the second external refrigerant circuit section 28B, which is downstream of the orifice 281 and upstream of the first heat exchanger 29. The opening degree of the valve hole 41 is determined by the balance of the electromagnetic force produced by the solenoid 34, the force of the urging spring 33, and the force of the pressure sensing device 44.

The pressure sensing device 44 obtains the pressure at a first position (the first external refrigerant circuit section 28A) and the pressure at a second position (the second external refrigerant circuit section 28B) in the discharge pressure zone (the first and second external refrigerant circuit sections 28A, 28B), and limits the position of the actuation rod 38, that is, the position of the valve body 381, according to the pressure difference between the pressure at the first position and the pressure at the second position. That is, the pressure sensing device 44 urges the valve body 381 with a force that corresponds to the pressure difference between the first position and the second position, which are located in the discharge pressure zone.

The control computer C shown in FIG. 1A executes current supply control (duty ratio control) for the solenoid 34 of the displacement control valve 32. When an air-conditioner switch 52 is ON, the control computer C supplies current to the solenoid 34. When the air-conditioner switch 52 is OFF, the control computer C stops supplying the current. The control computer C is connected to a compartment temperature setting device 53 and a compartment temperature detector 54. When the air-conditioner switch 52 is ON, the control computer C controls current supplied to the solenoid 34 based on the difference between a target compartment temperature set by the compartment temperature setting device 53 and the temperature detected by the compartment temperature detector 54. The valve opening degree of the valve hole 41 is reduced as the duty ratio is increased.

Figure 2B:
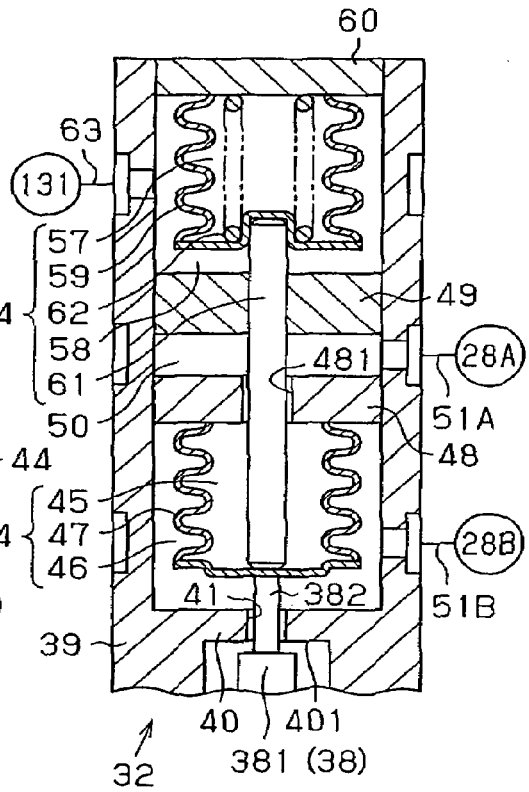
FIG. 2B is a partial cross-sectional view illustrating the displacement control valve of FIG. 2A.

When the valve hole 41 is open as shown in FIG. 2B, the refrigerant in the second external refrigerant circuit section 28B is sent to the control pressure chamber 121 through a supply passage 55 that includes the pressure introduction passage 51B, the second pressure sensing chamber 46, the valve hole 41, the valve chamber 42 and the passage 43. When the valve hole 41 is closed as shown in FIGS. 1A and 2A, the refrigerant in the second external refrigerant circuit section 28B is not sent to the control pressure chamber 121 through the supply passage 55.

The control pressure chamber 121 is connected to the suction chamber 131 through a delivery passage 56. The refrigerant in the control pressure chamber 121 can flow to the suction chamber 131 through the delivery passage 56. The pressure in the control pressure chamber 121 is adjusted by the supply of refrigerant to the control pressure chamber 121 from the discharge chamber 132 through the discharge passage 27, the first and second external refrigerant circuit sections 28A, 28B, and the supply passage 55, and the delivery of refrigerant to the suction chamber 131 from the control pressure chamber 121 through the delivery passage 56.

As shown in FIG. 2A, a first pressure chamber 57 and a second pressure chamber 58 are defined in the housing 39. The first pressure chamber 57 and the second pressure chamber 58 are defined by a second bellows 59. A fixed end of the second bellows 59 is coupled to an end wall 60, which is a part of the housing 39. A movable end of the second bellows 59 is fixed to a transmission rod 61. The transmission rod 61 extends through the partition 49 and projects into the first pressure sensing chamber 45 from the through hole 481.

The interior of the first pressure chamber 57 is held in the near vacuum. An urging spring 62 is accommodated in the first pressure chamber 57. The urging spring 62 urges the second bellows 59 in a direction causing the transmission rod 61 to approach the valve hole 41 (a direction extending the second bellows 59). The second pressure chamber 58 communicates with the suction chamber 131 through a passage 63, and the second pressure chamber 58 is exposed to the pressure in the suction chamber 131 (suction pressure). That is, the interior of the second pressure chamber 58 is exposed to the pressure in the suction pressure zone. The pressure in the second pressure chamber 58 and the spring force (pressure) of the urging spring 62 in the first pressure chamber 57 oppose each other with the second bellows 59 in between.

The second bellows 59 exhibits a force for extending itself that acts against the pressure (suction pressure) in the second pressure chamber 58. When the suction pressure is lowered, the transmission rod 61 tends to move toward the valve hole 41. That is, when the suction pressure decreases, the transmission rod 61 contacts the first bellows 47, which is a part of the pressure sensing device 44, and acts to extend the first bellows 47.

As shown in FIG. 2B, in a state where the valve hole 41 of the displacement control valve 32 is open, the refrigerant in the discharge chamber 132 is sent to the control pressure chamber 121 through the supply passage 55. The refrigerant in the control pressure chamber 121 flows to the suction chamber 131 through the delivery passage 56. However, in a state where the valve hole 41 is open, the pressure in the control pressure chamber 121 is high and the inclination angle of the swash plate 22 is less than the maximum inclination angle.

When the valve hole 41 of the displacement control valve 32 is closed as shown in FIGS. 1A and 2A, the refrigerant in the discharge chamber 132 is not sent to the control pressure chamber 121 through the supply passage 55. The refrigerant in the control pressure chamber 121 flows to the suction chamber 131 through the delivery passage 56. Thus, in a state where the valve hole 41 is closed, the pressure in the control pressure chamber 121 is low and the inclination angle of the swash plate 22 is maximized. In this state, the stroke of each piston 24 is maximized, and the displacement of the compressor 10 is maximized, accordingly.

A case where the variable displacement compressor 10 operates at a high speed with the valve hole 41 closed will now be discussed. If this state continues, the pressure of refrigerant that has passed through the second heat exchanger 31 (the pressure in the suction pressure zone) decreases. This decreases the pressure in the second pressure chamber 58. Accordingly, the second bellows 59 shows a tendency to extend. When the pressure in the suction pressure zone is less than or equal to a predetermined reference pressure Po, the transmission rod 61 moves the actuation rod 38 (the valve body 381) against the electromagnetic force of the solenoid 34 as shown in FIG. 2B, thereby opening the valve hole 41. This causes the refrigerant in the second external refrigerant circuit section 28B to flow into the control pressure chamber 121 through the supply passage 55. As a result, the inclination angle of the swash plate 22 is shifted toward the minimum inclination angle. This prevents the variable displacement compressor 10 from operating with a large displacement while operating at a high speed.

When a situation of an insufficient amount of refrigerant occurs, the shortage of refrigerant lowers the pressure in the suction pressure zone. When the pressure in the suction pressure zone is less than or equal to the predetermined reference pressure Po, the transmission rod 61 moves the actuation rod 38 (the valve body 381) against the electromagnetic force of the solenoid 34, thereby opening the valve hole 41. As a result, the inclination angle of the swash plate 22 is shifted toward the minimum inclination angle. This prevents the variable displacement compressor 10 from operating with a large displacement in a state of an insufficient amount of refrigerant.

The reference pressure Po is determined in consideration of a case where the total amount of refrigerant is less than the required amount of refrigerant, and a case where the variable displacement compressor 10 operates at a high speed with the valve hole 41 closed. For example, the lowest value of the suction pressure range that satisfies the reliability requirement of the variable displacement compressor 10 is set as the reference pressure Po. The first pressure chamber 57, the second pressure chamber 58, the second bellows 59, the transmission rod 61, and the urging spring 62 form a displacing device 64. The displacing device 64 opens the valve hole 41 when the pressure in the suction pressure zone becomes less than or equal to the reference pressure Po less than or equal to. The transmission rod 61 is a displacement transmitter that transmits displacement of the second bellows 59 serving as a displacement member to the valve body 381 through the first bellows 47 serving as a defining member. The displacing device 64 is installed in the displacement control valve 32.

The first embodiment provides the following advantages.

(1-1) When the pressure in the suction chamber 131 (the suction pressure zone) falls below the predetermined reference pressure Po, the transmission rod 61 of the displacing device 64 moves the valve body 381 away from the valve hole 41, thereby increasing the opening degree of the valve hole 41 in the displacement control valve 32. This increases the amount of refrigerant sent from the second external refrigerant circuit section 28B (the discharge pressure zone) to the control pressure chamber 121. Accordingly, the pressure in the control pressure chamber 121 is increased, and the displacement of the compressor 10 is reduced. Therefore, the compressor 10 is prevented from operating with a large displacement when there is insufficient amount of refrigerant or when the speed of the compressor is high.

(1-2) The displacing device 64 is installed in the displacement control valve 32. In the configuration where the displacing device 64 is installed in the displacement control valve 32, the displacing device 64 and the displacement control valve 32 can be handled as a single component. Therefore, the installation of the displacing device 64 and the displacement control valve 32 in the variable displacement compressor 10 is easier than a case where the displacing device 64 are the displacement control valve 32 separately installed in the compressor 10.

(1-3) In the hinge mechanism 23, the projections 221, 222 formed on the swash plate 22 are simply held between the arms 212, 213 formed on the rotary support 21, which permits the swash plate 22 to move freely with respect to the axial direction of the rotary shaft 18. Therefore, particularly in the variable displacement compressor 10 using the hinge mechanism 23, a large displacement operation with an insufficient amount of refrigerant or at a high speed can cause the inclination angle of the swash plate 22 in the maximum displacement operating state to surpass the predetermined maximum inclination angle. The present invention, which uses the displacing device 64, is particularly suitable for the variable displacement compressor 10, which has the hinge mechanism 23.

Figure 3A:
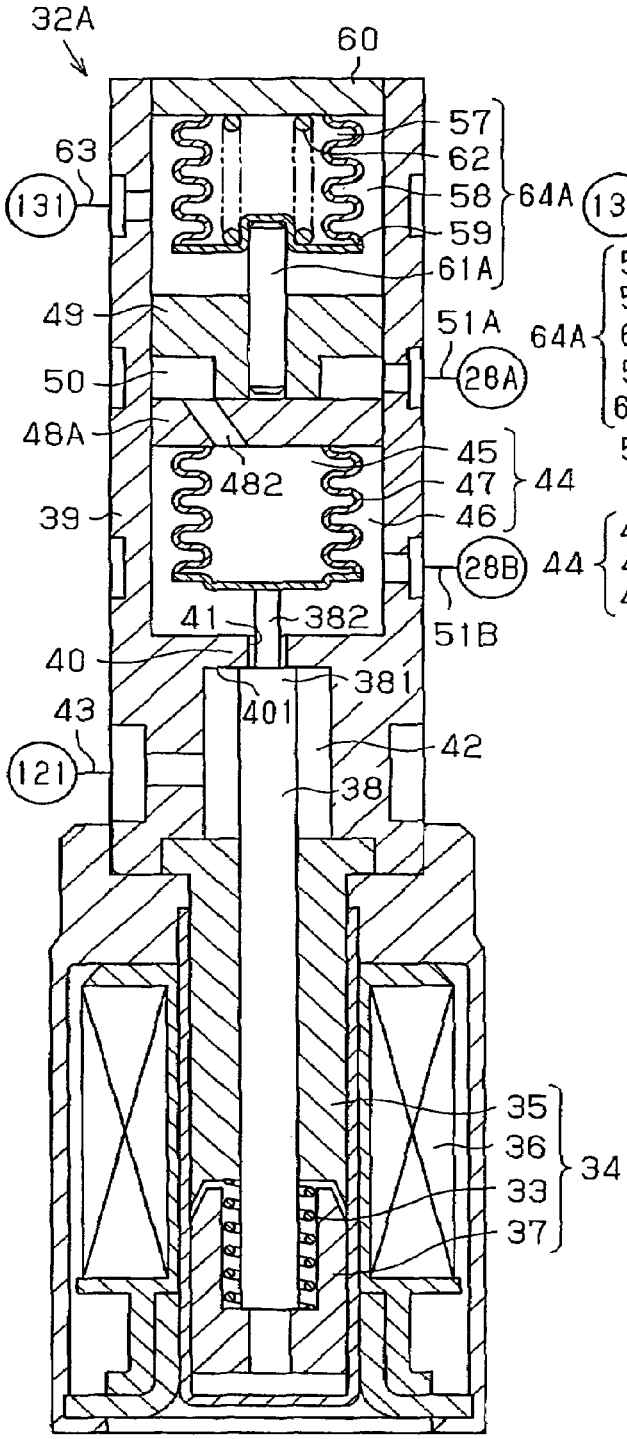
FIG. 3A is a cross-sectional view illustrating a displacement control valve according to a second embodiment of the present invention.

A second embodiment according to the present invention will now be described with reference to FIGS. 3A and 3B. Same reference numerals are used for those components which are the same as the corresponding components of the first embodiment. The support 48A supporting the first bellows 47 is slidably inserted into the housing 39. A through hole 482 is formed in the support 48A. The first pressure sensing chamber 45 communicates with the refrigerant introduction chamber 50 through the through hole 482. A transmission rod 61A serving as a displacement transmitter extends through the partition 49 and can contact the support 48A. The first pressure chamber 57, the second pressure chamber 58, the second bellows 59, the transmission rod 61A, and the urging spring 62 form a displacing device 64A, which is installed in a displacement control valve 32A.

Figure 3B:
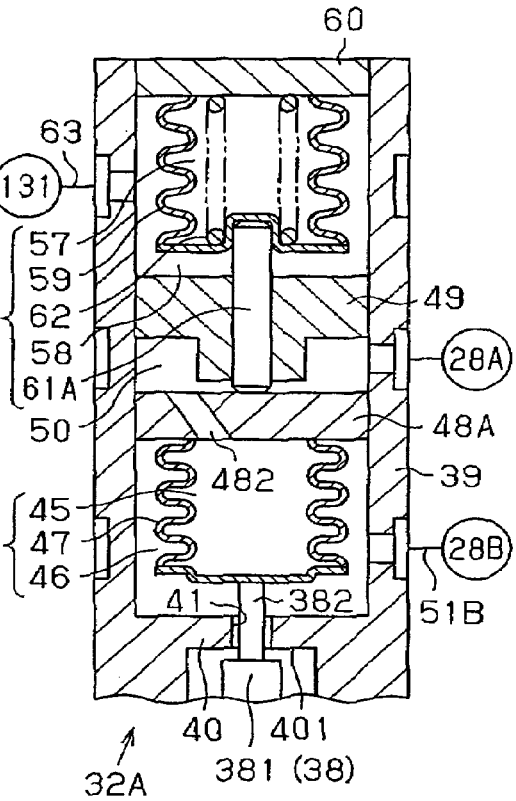
FIG. 3B is a partial cross-sectional view illustrating the displacement control valve of FIG. 3A.

When the pressure in the suction pressure zone is less than or equal to the predetermined reference pressure Po, the transmission rod 61A moves the support 48A away from the partition 49 as shown in FIG. 3B so that the first bellows 47 is moved together with the support 48A. Accordingly, the actuation rod 38 (the valve body 381) is moved against the electromagnetic force of the solenoid 34, and the valve hole 41 is opened, so that the refrigerant in the second external refrigerant circuit section 28B flows into the control pressure chamber 121 through the supply passage 55. As a result, the inclination angle of the swash plate 22 is shifted toward the minimum inclination angle. This prevents the variable displacement compressor 10 from operating with a large displacement when there is insufficient amount of refrigerant or when the speed of the compressor is high.

The second embodiment provides the same advantages as the first embodiment.

A third embodiment will now be described with reference to FIGS. 4, 5A, and 5B. Same reference numerals are used for those components which are the same as the corresponding components of the first embodiment.

Figure 4:
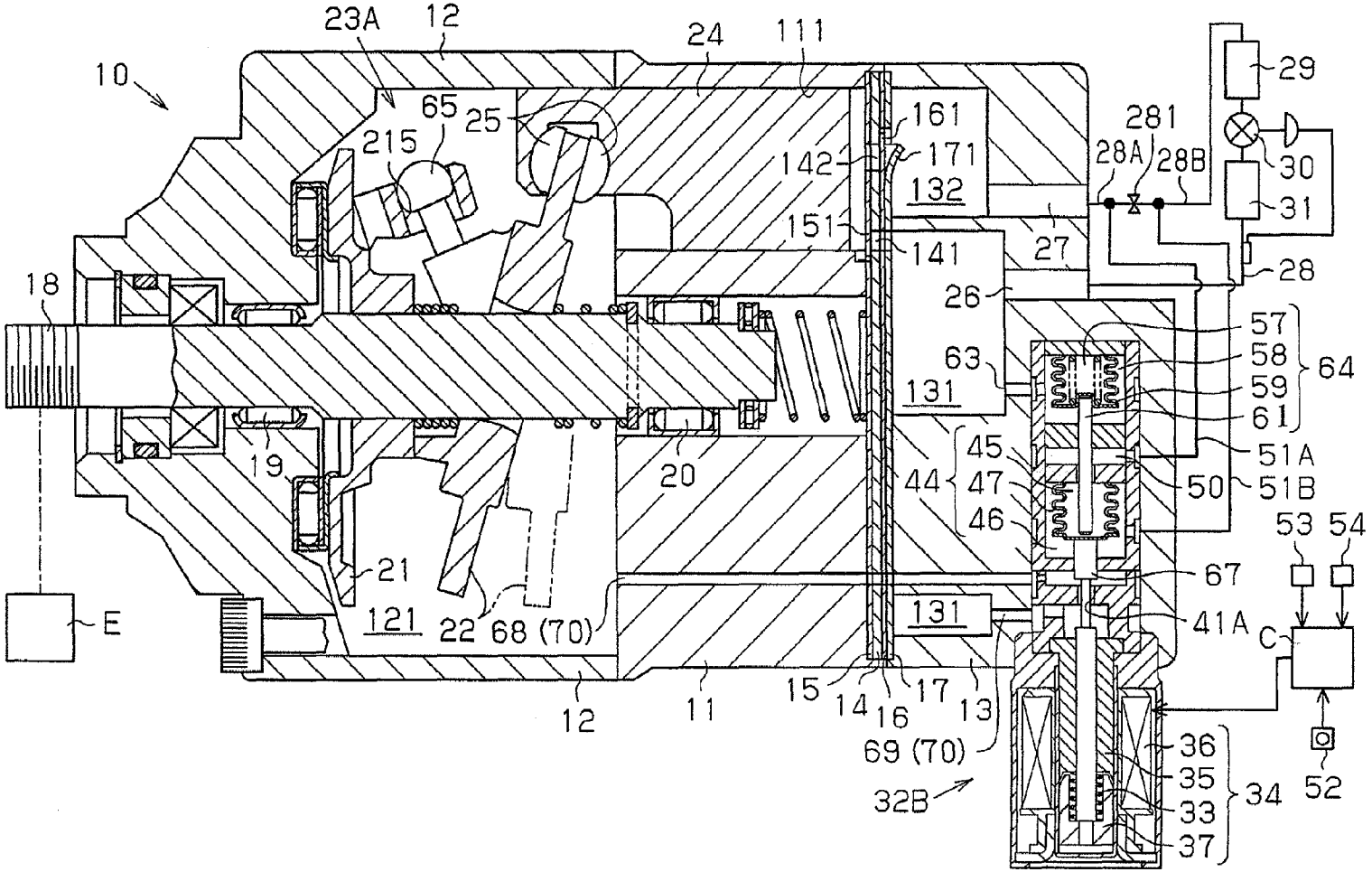
FIG. 4 is a side cross-sectional view illustrating an entire compressor according a third embodiment of the present invention.

As shown in FIG. 4, a pair of guide holes 215 are formed in the rotary support 21, and a pair of guide pins 65 are formed on the swash plate 22. The guide pins 65 are slidably fitted in the guide holes 215. The engagement of the guide pins 65 with the circumferential surfaces of the guide holes 215 allows the swash plate 22 to tilt with respect to the rotary shaft 18 and rotate together with the rotary shaft 18. The circumferential surfaces of the guide holes 215 slidably guide the guide pins 65, and the rotary shaft 18 slidably supports the swash plate 22. These actions permit the swash plate 22 to be inclined. The guide holes 215 and the guide pins 65 form a hinge mechanism 23A that couples the swash plate 22 to the rotary support 21, such that the swash plate 22 can be inclined and that torque can be transmitted.

Figure 5A:
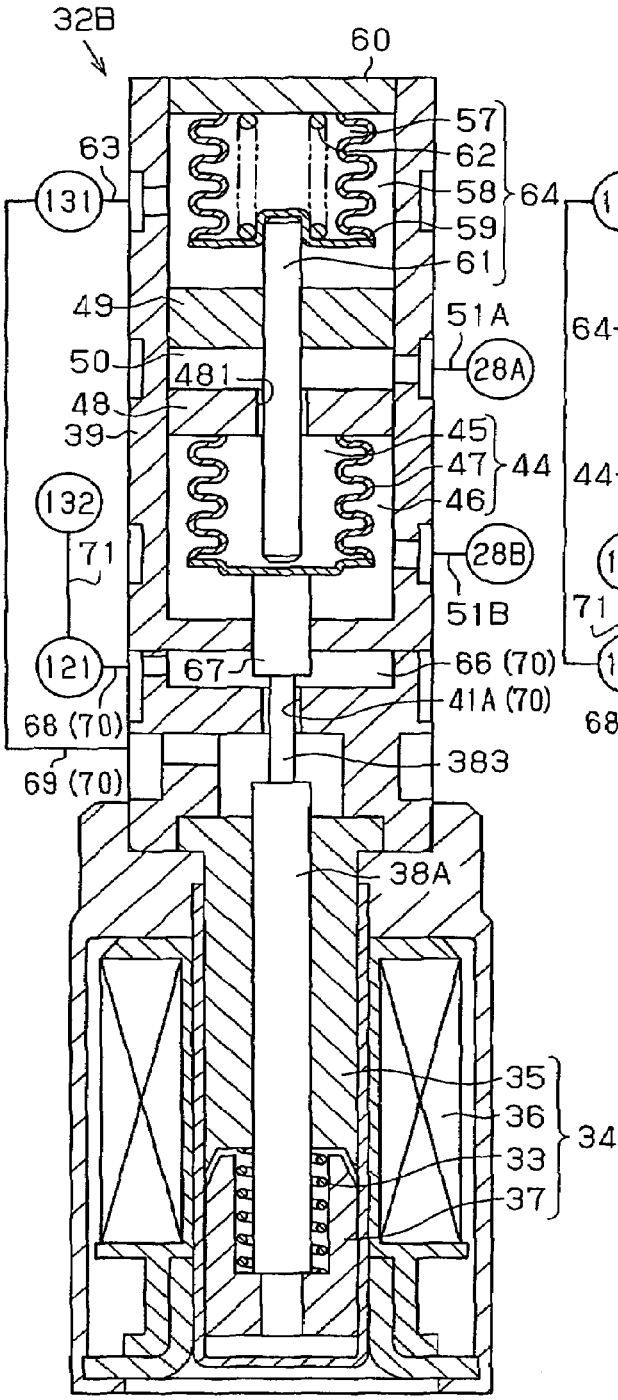
FIG. 5A is an enlarged cross-sectional view illustrating the displacement control valve shown in FIG. 4.

As shown in FIG. 5A, a valve hole 41A of a displacement control valve 32B is connected to a valve chamber 66. A valve body 67 is accommodated in the valve chamber 66. The valve body 67 is coupled to the first bellows 47. The valve body 67 is secured to a small diameter portion 383 of an actuation rod 38A, so that the valve body 67 moves together with the actuation rod 38A.

The valve chamber 66 communicates with the control pressure chamber 121 through a passage 68, and the valve hole 41A communicates with the suction chamber 131 through a passage 69. The passage 68, the valve chamber 66, the valve hole 41A, and the passage 69 form a delivery passage 70 for discharging the refrigerant in the control pressure chamber 121 to the suction chamber 131. The discharge chamber 132 (discharge pressure zone) and the control pressure chamber 121 communicate with each other through a supply passage 71 shown in FIGS. 5A and 5B.

The control computer C controls current supplied to the solenoid 34 based on the difference between a target compartment temperature set by the compartment temperature setting device 53 and the temperature detected by the compartment temperature detector 54. The valve opening degree of the valve hole 41A is increased as the duty ratio is increased.

Figure 5B:
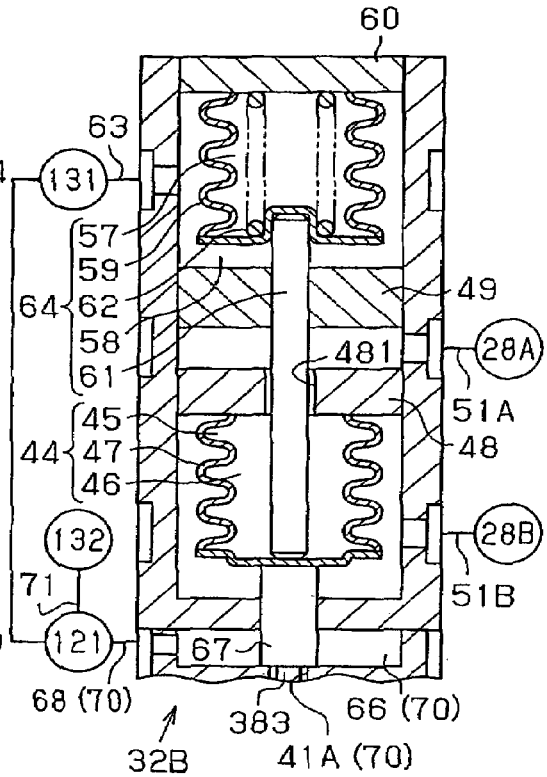
FIG. 5B is a partial cross-sectional view illustrating the displacement control valve of FIG. 5A.

As shown in FIG. 5B, in a state where the valve hole 41A is closed, the refrigerant in the control pressure chamber 121 does not flow to the suction chamber 131 through the delivery passage 70. The refrigerant in the discharge chamber 132 is sent to the control pressure chamber 121 through the supply passage 71. Therefore, in a state where the valve hole 41A is closed, the pressure in the control pressure chamber 121 is high and the inclination angle of the swash plate 22 is less than the maximum inclination angle.

In a state of FIGS. 4 and 5A, the valve hole 41A of the displacement control valve 32B is maximally opened, so that the refrigerant in the control pressure chamber 121 is flowing to the suction chamber 131 through the delivery passage 70. The refrigerant in the discharge chamber 132 is sent to the control pressure chamber 121 through the supply passage 71. However, in a state where the valve hole 41A is maximally opened, the pressure in the control pressure chamber 121 is low and the inclination angle of the swash plate 22 is maximized. In this state, the stroke of each piston 24 is maximized, and the displacement of the compressor 10 is maximized, accordingly.

When the pressure in the suction chamber 131 is less than or equal to the predetermined reference pressure Po, the transmission rod 61 moves the valve body 67 toward a position for closing the valve hole 41A, thereby closing the valve hole 41A. As a result, the inclination angle of the swash plate 22 is shifted toward the minimum inclination angle. This prevents the variable displacement compressor 10 from operating with a large displacement when there is insufficient amount of refrigerant or when the speed of the compressor is high.

The invention may be embodied in the following forms.

(1) The displacing device 64, 64A may be formed separately from the displacement control valve 32, 32A, 32B.

(2) A displacing device may be employed in which, when the suction pressure is detected by a pressure sensor and the pressure sensor detects that the suction pressure becomes less than or equal to the reference pressure Po, the valve body 381, 67 is displaced by an electric actuator (for example, a solenoid).

(3) The second bellows 59 may be replaced by a displacing device that includes a diaphragm as a displacement member.

(4) The second bellows 59 or the diaphragm may be replaced by a displacing device that includes a piston-like movable wall as a displacement member.

(5) The first bellows 47 may be replaced by a pressure sensing device that includes a diaphragm as a defining member.

(6) The first bellows 47 or the diaphragm may be replaced by a pressure sensing device that includes a piston-like movable wall as a defining member.

(7) In the first embodiment, the arms 212, 213 may be formed on the swash plate 22, and the projections 221, 222 may be formed on the rotary support 21.

Although the multiple embodiments have been described herein, it will be clear to those skilled in the art that the present invention may be embodied in different specific forms without departing from the spirit of the invention. The invention is not to be limited to the details given herein, but may be modified within the scope and equivalence of the appended claims.

The invention claimed is:

1. A displacement control mechanism for a variable displacement compressor that compresses refrigerant in a suction pressure zone and delivers the compressed refrigerant to a discharge pressure zone, the compressor includes a control pressure chamber, a supply passage that connects the discharge pressure zone to the control pressure chamber, and a delivery passage that connects the suction pressure zone to the control pressure chamber, the displacement control mechanism permits refrigerant in the discharge pressure zone to be supplied to the control pressure chamber through the supply passage and permits refrigerant in the control pressure chamber to be delivered to the suction pressure zone through the delivery passage, thereby adjusting the pressure in the control pressure chamber to control the displacement of the compressor, the displacement control mechanism comprising:

a valve hole forming part of the supply passage or the delivery passage;

a valve body for opening and closing the valve hole;

a pressure sensing device that urges the valve body with a force that corresponds to a pressure difference between a first position and a second position, said first and second positions being located in the discharge pressure zone; and a displacing device configured to displace the valve body, when a pressure in the suction pressure zone falls below a predetermined reference pressure, the displacing device being further configured to displace the valve body in a direction increasing the opening degree of the valve hole with the driving force, when the valve forms part of the supply passage, and the displacing device being further configured to displace the valve body in a direction reducing the opening degree of the valve hole with the driving force, when the valve hole forms part of the delivery passage.

2. The displacement control mechanism according to claim 1, wherein the displacing device includes:

a first pressure chamber;

a second pressure chamber that communicates with the suction pressure zone;

a displacement member that separates the first pressure chamber and the second pressure chamber from each other; and a displacement transmitter that transmits displacement of the displacement member to the valve body, wherein a pressure in the first pressure chamber and a pressure in the second pressure chamber act against each other with the displacement member in between.

3. The displacement control mechanism according to claim 2, wherein the pressure sensing device includes:

a first pressure sensing chamber and a second pressure sensing chamber;

a displaceable defining member that defines the first pressure sensing chamber and the second pressure sensing chamber, wherein the valve body can be moved together with the defining member;

the first pressure sensing chamber being exposed to the pressure at the first position;

the second pressure sensing chamber being exposed to the pressure at the second position.

4. The displacement control mechanism according to claim 3, wherein the displacement transmitter is a transmission rod coupled to the displacement member, said transmission rod transmits displacement of the displacement member to the valve body through the defining member.

5. The displacement control mechanism according to claim 4, further comprising a partition that defines an introduction chamber between the displacing device and the pressure sensing device, the introduction chamber being exposed to one of the pressure at the first position and the pressure at the second position, wherein the transmission rod extends through the partition.

6. The displacement control mechanism according to claim 3, wherein the defining member is supported by a support that can be displaced, the displacement transmitter is a transmission rod coupled to the displacement member, and the transmission rod transmits displacement of the displacement member to the valve body through the support and the defining member.

7. The displacement control mechanism according to claim 2, wherein the displacement member is a bellows.

8. The displacement control mechanism according to claim 1, wherein the variable displacement compressor includes:

a rotary shaft;

a rotary support fixed to the rotary shaft;

a swash plate that is supported by the rotary shaft such that the swash plate is slidable along an axial direction of the rotary shaft and tiltable relative to the rotary shaft; and a hinge mechanism located between the swash plate and the rotary support, the hinge mechanism couples the swash plate to the rotary support such that the swash plate is tiltable and that torque can be transmitted, wherein the hinge mechanism includes a projection formed on one of the rotary support and the swash plate, and a plurality of arms formed on the other one of the rotary support and the swash plate, and wherein the projection is inserted in a recess defined by the arms.

9. The displacement control mechanism according to claim 1, further comprising a solenoid that can produce electromagnetic force for urging the valve body.

* * * * *